United States Patent [19]

Hatanaka et al.

[11] Patent Number: 4,914,274

[45] Date of Patent: Apr. 3, 1990

[54] DIESEL ENGINE GLOW PLUG HAVING SIALON HEATER

[75] Inventors: Koji Hatanaka; Takashi Aota; Kenji Maruta; Hirohisa Suwabe; Seiji Okazaki, all of Saitama, Japan

[73] Assignees: Jidosha Kiki Co., Ltd., Shibuya; Hitachi Metals, Ltd., Chiyoda, both of Japan

[21] Appl. No.: 382,087

[22] Filed: Jul. 19, 1989

Related U.S. Application Data

[63] Continuation of Ser. No. 146,291, Jan. 20, 1988, abandoned.

[30] Foreign Application Priority Data

Jan. 22, 1987 [JP] Japan ..... 62-11523
May 28, 1987 [JP] Japan ..... 62-81651[U]

[51] Int. Cl.[4] ..... F23Q 7/24; F02P 19/02; H05B 3/00

[52] U.S. Cl. ..... 219/270; 123/145 A; 219/541; 219/522

[58] Field of Search ..... 219/270, 523, 552, 553, 219/541; 361/261-264; 123/145 R, 145 A

[56] References Cited

U.S. PATENT DOCUMENTS 4,475,029 10/1984 Yoshida et al. ..... 219/270
4,741,692 5/1988 Sadakata et al. ..... 123/145 A
4,742,209 5/1988 Minegishi et al. ..... 123/145 A

FOREIGN PATENT DOCUMENTS 3707814 9/1987 Fed. Rep. of Germany ..... 219/270
3712414 10/1987 Fed. Rep. of Germany ..... 219/270
54-95627 7/1979 Japan .
57-199759 12/1982 Japan .
58-62427 4/1983 Japan ..... 219/270
60-14784 1/1985 Japan .

*Primary Examiner*—Anthony Bartis
*Attorney, Agent, or Firm*—Blakely, Sokoloff, Taylor & Zafman

[57] ABSTRACT

A glow plug for a diesel engine includes a hollow holder, and a ceramic heater made of SiAlON extending through a distal end portion of the hollow holder and held by it. The ceramic heater is provided with a U-shaped heating element and a pair of lead portions extending backward from both ends of the U-shaped heating element and parallel to each other. The heating element and the pair of lead portions are integrally made of a resistive ceramic material. One of the lead portions is coupled to one end of an electrically conducting flexible wire, the other end of the wire being coupled to an external connecting terminal. A ration $\epsilon(=SH/SL)$ of cross-sectional areas SH of the U-shaped heating element to cross-section areas SL of the lead portions falls within the range of $0.15 \leqq \epsilon \geqq 0.6$.

6 Claims, 5 Drawing Sheets

DIESEL ENGINE GLOW PLUG HAVING SIALON HEATER

This is a continuation of application Ser. No. 146,291 filed 1/20/88.

BACKGROUND OF THE INVENTION

The present invention relates to a glow plug for preheating a subcombustion or combustion chamber of a diesel engine and, more particularly, to an improvement of a diesel engine glow plug of a bipolar two-line system having a ceramic heater which has high-speed and self temperature saturation properties and which allows "after glow" operation for a long period of time.

Conventional glow plugs having various types of structures have been proposed. Among these glow plugs, a plug having a ceramic heater has received a great deal of attention as a fast heating plug.

A glow plug of a ceramic heater type is described in Japanese Patent Laid-Open No. 60-14784. This glow plug has a structure wherein a heating element is exposed on the outer surface of a heater by using a resistive ceramic material having substantially the same thermal expansion coefficient as that of an insulating ceramic material constituting a heater insulating element, so that the heating element is integrally formed with the heater insulating element. With this structure, the distal end of the heater can be immediately heated to obtain a fast heating glow plug. At the same time, bonding between the heating element and the heater insulating element can be optimally and appropriately maintained to improve reliability for heat resistance or the like to some extent.

In a conventional glow plug of a ceramic heater type having the structure as described above, however, many problems are left unsolved from the structural and functional points of view when such a plug is used as a practical glow plug.

In a glow plug of this type, the distal end of the heater can be immediately heated to obtain a high-performance fast heating glow plug. At the same time, smooth and appropriate combustion inside the engine can be achieved due to recent improvements in the starting characteristics of the diesel engine and in durability for high-temperature operating conditions caused by turbo mechanization of diesel engines, as well as maintenance of an energizing state of the glow plug for a predetermined period of time after starting of the engine. This combustion condition allows reduction of an exhaust gas and noise. Market demand has arisen for such an after glow system, and maximum prolongation of the after glow time (e.g., 10 minutes) is required. In order to prolong the after glow time, energization power to the heating element must be self-controlled to greatly improve the heating characteristics, overheating of the heater portion must be prevented, and a self temperature saturation function is required to keep the saturation temperature below an appropriate temperature. At the time of after glow operation, a voltage applied to the glow plug is kept lower than that applied at the time of energization of the plug so as to assure durability of the heating wire. The conventional ceramic heater cannot satisfy the above needs. In a conventional heater structure, the heating portion of the distal end of the heater is generally made thin to obtain the fast heating properties. With this structure, however, the self temperature saturation properties cannot be obtained. In addition, the heat-resistive strength of the conventional structure is not satisfactory either. In consideration of these points, demand has arisen for providing countermeasures to obtain particularly self temperature saturation properties.

SUMMARY OF THE INVENTION

It is a principal object of the present invention to provide a low-cost diesel engine glow plug wherein fast heating can be achieved.

It is another object of the present invention to provide a diesel engine glow plug having a small heat capacity heating element and good self temperature saturation properties, thereby properly controlling the saturation temperature.

It is still another object of the present invention to provide a diesel engine glow plug wherein voltage control during after glow operation can be easily achieved.

It is still another object of the present invention to provide a diesel engine glow plug wherein durability of the heating element can be improved.

In order to achieve the above objects of the present invention, there is provided a glow plug for a diesel engine having the following structure. A hollow holder with a ceramic heater extending through a distal end portion of the hollow holder and held thereby. The ceramic heater has a U-shaped heating element and a pair of lead portions extending backward from both ends of the U-shaped heating element and parallel to each other. The heating element and the pair of lead portions are integrally made of a resistive ceramic material. A ratio $\epsilon(=SH/SL)$ of cross-sectional areas SH of the U-shaped heating element to cross-sectional areas SL of the lead portions falls within a range of $0.15 \leqq \epsilon \leqq 0.6$.

DESCRIPTION OF THE PREFERRED EMBODIMENTS

Figure 1:
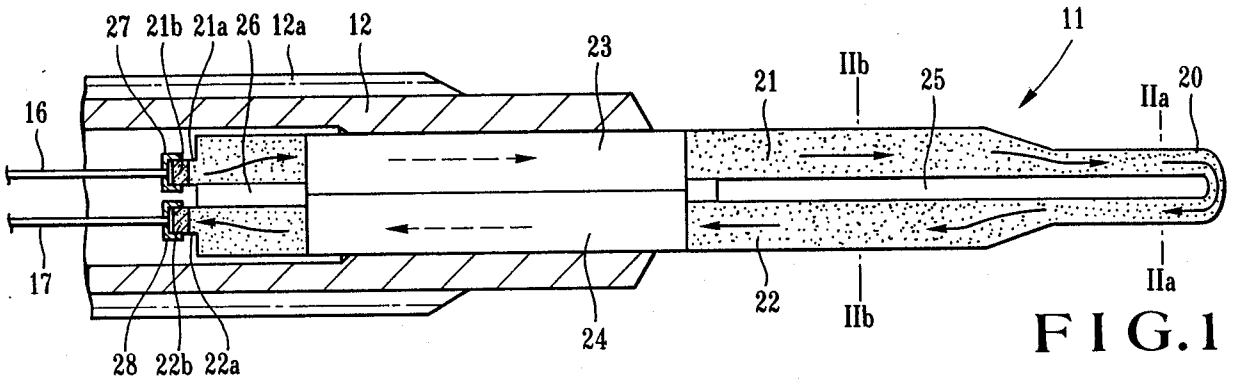
FIG. 1 is an enlarged sectional view showing the main part of a glow plug for a diesel engine according to an embodiment of the present invention.
Figure 2B:
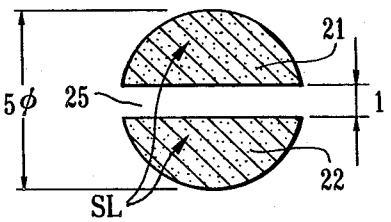
FIGS. 2(*a*) and 2(*b*) are sectional views of the glow plug in FIG. 1 taken along the lines II*a*–II*a* and II*b*–II*b* thereof.
Figure 2A:
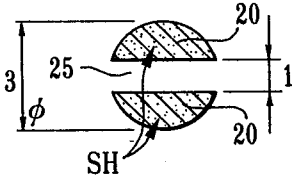

The present invention will be described in detail with reference to the preferred embodiments in conjunction with the accompanying drawings.

FIGS. 1 to 7 show a diesel engine glow plug according to an embodiment of the present invention. The schematic structure of a glow plug 10 in FIG. 4 will be briefly described. The glow plug 10 comprises a rod-like ceramic heater 11 whose distal end portion serves as a heating element and a tubular metal holder 12 for holding the heater 11 at its distal end. A terminal assembly 15 is fitted and held in the rear end portion of the holder 12. The terminal assembly 15 is prepared such that first and second external connecting terminals 13 and 14 are embedded and extended through an insulating material, such as a synthetic resin material. The terminals 13 and 14 are respectively connected through metal wires 16 and 17 such as flexible wires to lead portions (to be described later) of a resistive ceramic material constituting the heater 11. The metal wires 16 and 17 serve to mechanically protect the heater 11 from an external mechanical force such as various kinds of vibrations and a fastening torque, all of which act on the external connecting terminals 13 and 14. In this sense, the metal wires 16 and 17 must be flexible to a given extent. A threaded portion 12*a* is formed on the outer surface of the holder 12 and can be threadably engaged wtih a screw hole in an engine cylinder head (not shown).

The terminal assembly 15 has the first external connecting terminal 13, the second external connecting terminal 14, and an assembly body 15*a*. The first connecting terminal 13 is located on the axis of the assembly 15 and has a rod 13*a* at an inner end side thereof. The rod 13*a* is connected to the metal wire 16. The second external connecting terminal 14 comprises a cylindrical member disposed around the first external connecting terminal 13 spaced by a predetermined distance therefrom. A lead piece 14*a* extending from part of the inner end of the second external connecting terminal 14 is connected to the metal wire 17. The assembly body 15*a* insulates the terminals 13 and 14 from each other and has an insulating layer on the outer surface of the second terminal 14. In this manner, the assembly body 15*a* integrally supports and holds the first and second terminals 13 and 14. A connection reinforcing metal pipe 15*b* is fitted on the outer surface of the body 15*a*. The metal pipe 15*b* is caulked at the edge of the rear opening of the holder 12 at a high pressure and is compressed along the axial direction. The inner side of the metal pipe 15*b* is compressed against the side of the assembly body 15*a*, and the outer side of the metal pipe 15*a* is firmly compressed against the inner wall surface of the holder 12; thereby solving problems associated with an external force and thermal shrinkage.

Reference numerals 18*a* and 18*b* respectively denote an insulating ring and a washer, both of which are mounted on the second terminal 14 extending in the rear portion of the holder 12; 18*c*, an insulating member mounted on the side of the first terminal 13 at the outer end of the washer 18*b*; and 18*d* and 18*e*, a spring washer and a fastening nut, respectively, both of which are threadably engaged with the threaded portion formed on the outer end of the first terminal 13. Lead wires (not shown) connected to a battery are clamped between the washer 18*b* and the insulating member 18*c* and between the insulating member 18*c* and the spring washer 18*d*, so that the terminals 13 and 14 are electrically connected to the battery terminals. Reference numerals 16*a* and 17*a* denote insulating members such as tubes coated on the metal wires 16 and 17, respectively.

With the glow plug 10 having the structure as described above, the rod-like ceramic heater 11 held at the distal end of the holder 12 is designed to be a substantially U-shaped structure wherein a U-shaped heating element 20 and a pair of parallel lead portions 21 and 22 extending backward from the both ends of the U-shaped heating element are integrally made of a resistive ceramic material. The thickness of the U-shaped heating element 20 is smaller than that of the lead portions 21 and 22 such that a ratio $\epsilon(=SH/SL)$ of sectional areas SH of the U-shaped heating element 20 to sectional areas SL of the lead portions 21 and 22 falls within the range of $0.15 \leqq \epsilon \leqq 0.6$. This is the characteristic feature of the present invention. Insulating coating layers 23 and 24 are formed on the outer surfaces of the lead portions 21 and 22 and are bonded to the distal end portion of the holder 12. At the same time, the rear end portions of the lead portions 21 and 22 are connected to the first and second external connecting terminals 13 and 14 insulatively held at the rear end portion of the holder 12 through the metal wires 16 and 17.

The above characteristic feature of the present invention will be described in more detail. The ceramic heater 11 comprises a resistive ceramic heating element 20 of an outer diameter and a cross section, both of which are smaller than the lead portions 21 and 22. A slit 25 is formed to extend between the lead portions 21 and 22 and the heating element 20 at the central portion of the heater 11 along its longitudinal direction. An insulating sheet 26 made of, e.g., an insulating ceramic material is inserted in the slit 25 between the lead portions 21 and 22 located on the rear end side of the slit 25. More specifically, the insulating sheet 26 is located at a portion corresponding to at least the distal end portion of the holder 12. The insulating sheet 26 is integrally bonded to the lead portions 21 and 22 made of a resistive ceramic material. Therefore, the slit 25 is sealed by the distal end portion of the holder 12 and combustion pressure and heat can be properly sealed and do not leak.

Insulating coating layers 23 and 24 (the uppermost layers thereof are silver-palladium layers) are formed on the outer surfaces at the central portions along the longitudinal direction of the lead portions 21 and 22 integrally formed of a resistive ceramic material together with the heating element 20. The layers 23 and 24 and the silver-palladium layers formed thereon allow sliver brazing of the ceramic heater 11 to the distal portion of the holder 12. In this case, the bonding surface portions of the holder 12 may have silver-palladium layers, as needed. However, the surface portions need not be coated with the silver-palladium layers.

The lead portions 21 and 22 have electrode extraction ends 21*a* and 22*a* extending backward therefrom, respectively. The electrode extraction ends 21*a* and 22*a* are electrically connected to the distal ends of the metal wires 16 and 17 extending from the first and second external connecting terminals 13 and 14 through terminal caps 27 and 28, respectively. A current is thus supplied through the ceramic heater 11, as indicated by a direction of an arrow in FIG. 1. Reference numerals 21*b* and 22*b* denote metallized layers formed on the electrode extraction ends 21*a* and 22*a* to connect terminal caps 27 and 28 thereto, respectively. In this case, a nickel paste is applied to the metallized layers 21*b* and 22*b* and baked at a high temperature, and the metal material can be appropriately and firmly bonded to the ceramic material. The terminal caps 27 and 28 have a shape matching with the electrode extraction ends 21*a* and 22*a* at the rear end portions of the heater 11. The terminal caps 27 and 28 are brazed by silver with the electrode extraction ends 21*a* and 22*a* while the caps 27 and 28 are engaged with the ends 21*a* and 22*a*, respectively. The metal wires 16 and 17 are bonded to the caps 27 and 28 as shown in FIG. 1 such that the flange portions at the distal ends thereof are attached to the end faces of the caps 27 and 28 at the time of sliver brazing as described above, thereby constituting the heater assembly. The other end of each of the metal wires 16 and 17 is spot-welded to the rod 13*a* and the lead piece 14*a* of the first and second external connecting terminals 13 and 14 in the terminal assembly 15. Note that reference numeral 29 denotes a sealing sheet made of asbestos, rubber, or the like mounted on the outer end of the terminal assembly 15 at the rear end opening of the holder 12 so as to mechanically seal the opening portion.

According to the bipolar two-line glow plug 10 having the above structure, the electrode extraction portions from the ceramic heater 11 are located within the holder 12 spaced away from the heating element 20. The electrode extraction portions can be maintained at a relatively low temperature. Reliability for heat resistance and the like can be greatly improved as compared with the conventional structure. As described above, the bonding portion between the ceramic heater 11 and the holder 12 does not require electrical ground but mechanical bonding. Therefore, reliability for bonding strength and the like can be improved.

The ceramic heater 11 is prepared such that a resistive ceramic paste is injected into a mold, and that a molded body is sintered. Alternatively, a ceramic heater having a rod-like shape is formed into a predetermined shape. After molding for forming, the insulating coating layers 23 and 24 (flame spraying with alumina) and the metallized layers 21*b* and 22*b* are respectively formed on the lead portions 21 and 22 and the outer surfaces of the electrode extraction ends 21*a* and 22*a*. Silver-palladium layers are formed on the surface portions to be bonded to the metal holder 12 in the subsequent process.

The ceramic heater 11 prepared as described above is incorporated into the holder 12 in a known manner shown that the outer surfaces of the lead portions 21 and 22 are brazed through the insulating layers (23 and 24), and that the rear end portions of the metal wires 16 and 17 are connected to the first and second external connecting terminals 13 and 14 held at the rear end portion of the holder 12, thereby assembling the glow plug 10.

A resistive ceramic material constituting a substantially U-shaped ceramic heater 11 is SiAlON obtained by controlling a mixing ratio of titanium nitride (TiN) to a SiAlON containing $\beta$-phase SiAlON (88% of $Si_3N_4$, 5% of $Al_2O_3$, and 7% of $Y_2O_3$) or $\alpha+\beta$-phase SiAlON. It is found that an electrical conductivity of positive resistance-temperature (PTC characteristics can be obtained when about 20% or more of TiN is added to the SiAlON (i.e., a conductive SiAlON). When the content of TiN is increased, the resistivity of the resultant SiAlON is known to be continuously changed. Therefore, a SiAlON compound containing a predetermined content of TiN can be used as needed. However, the resistive ceramic material serving as a resistor as the ceramic heater 11 is not limited to the above-mentioned SiAlON. It is therefore essential to use a ceramic material whose performance is stable at high temperatures (e.g., up to 1,200° C.) and a good resistance such as a good heat impact resistance. At least one nonoxide conductive material selected from the group consisting of SiC, and a carbonate, a borate, a nitride, or a carbon nitride of Group IVa, Va, and VIa of the Periodic Table is mixed with Al or an Al compound as a sintering binder to prepare a SiAlON sintered body.

A preferable insulating ceramic material for forming the above insulating sheet 26 is SiAlON which is prepared by controlling the content of titanium nitride (TiN) to obtain desired insulating and conductive properties in the same manner as the resistive ceramic material as that of the ceramic heater 11. This material is effective to increase bonding strength between the insulating sheet 26 and the resistor member. However, other preferable insulating ceramic materials having high heat-resistant strength and high bonding strength with the resistive ceramic material are materials containing $Si_3N_4$ or $Al_2O_3$ as a major constituent. It is also preferable to use glass or the like as an insulating material.

According to the structure according to the present invention, the heating element 20 made of a resistive ceramic material does not contain a foreign material and is exposed on the outer surface of the heater 11 to improve heating characteristics at the distal end of the heater 11. In a practical application, the glow plug has high reliability for heat resistance and high durability even if thermal stress repeatedly acts on the heating element 20. The heating element 20 also has good workability and is suitable for mass production. Therefore, the fabrication cost becomes low.

Figure 3B:
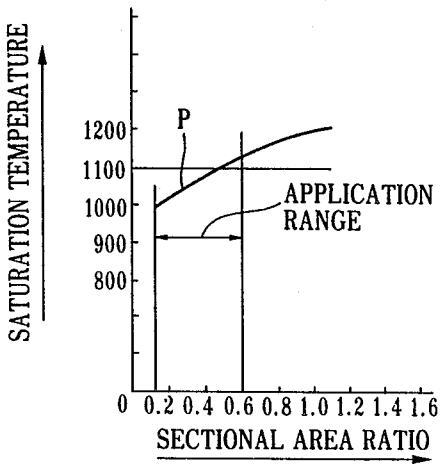
FIGS. 3(*a*) and 3(*b*) are graphs for selecting ratios of sectional areas of the ceramic heater to the sectional areas of the lead portions, respectively.
Figure 3A:
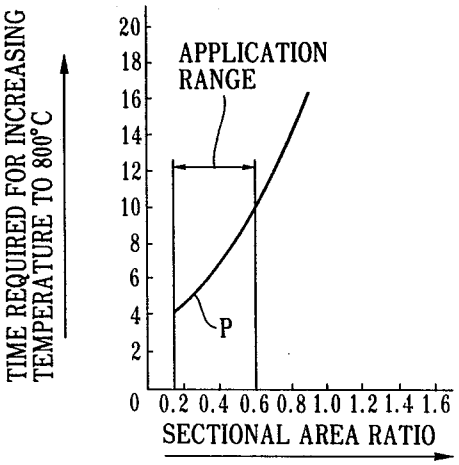
Figure 4:
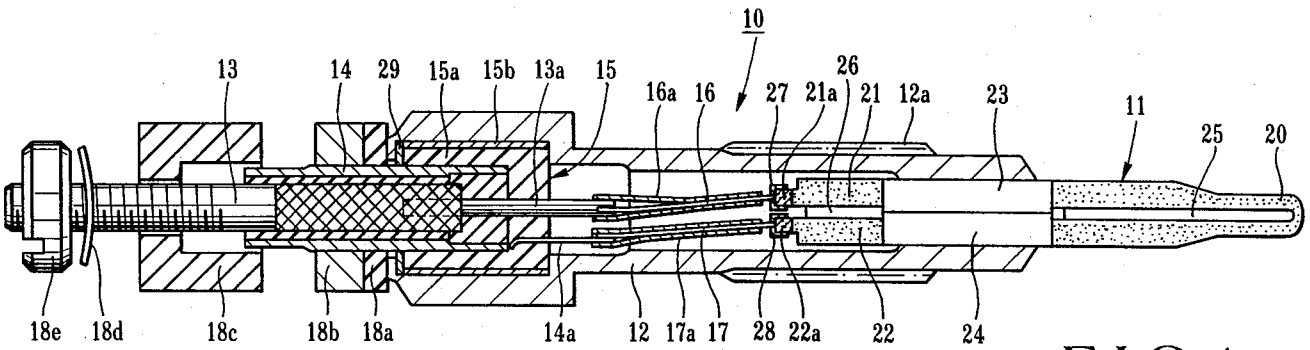
FIG. 4 is a schematic longitudinal sectional view showing the overall structure of the glow plug.
Figure 5:
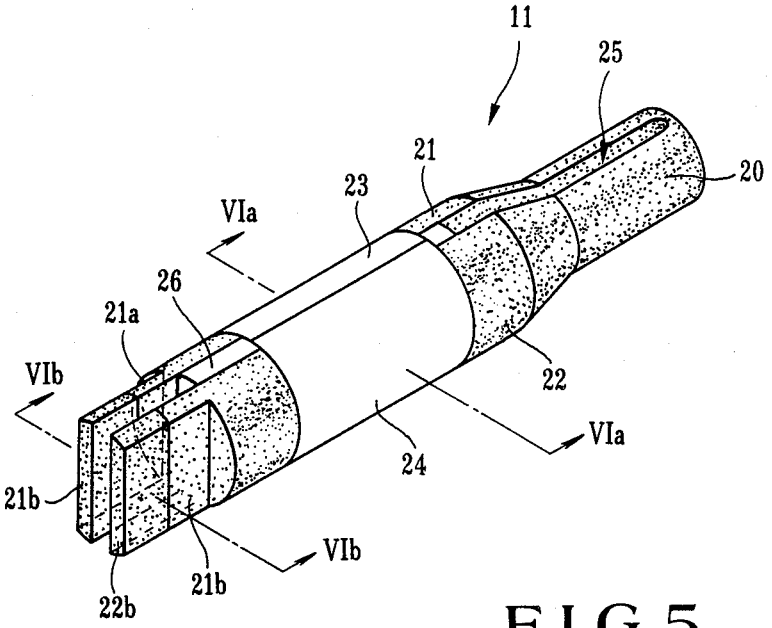
FIG. 5 is a schematic perspective view of the ceramic heater as the main part.
Figure 6A:
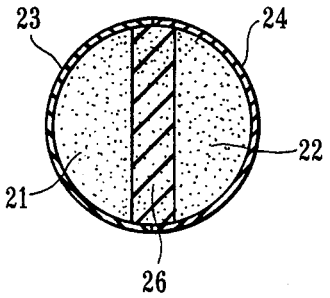
FIGS. 6(*a*) and 6(*b*) are sectional views of the ceramic heater shown in FIG. 5 taken along the lines VI*a*–VI*a* and VI*b*–VI*b* thereof, respectively.
Figure 6B:
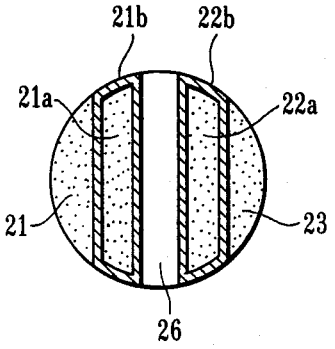

In the ceramic heater 11 according to the present invention, the resistivity of the conductive SiAlON constituting the heating element 20 and the pair of lead portions 21 and 22 can be controlled by the content of titanium nitride, and the thickness of the members can be arbitrarily controlled. In particular, the sectional area of the heating element 20 can be minimized to achieve fast heating, and its saturation temperature can be properly controlled to provide the after glow operation for a long period of time. According to the present invention, the ratio of the sectional areas of the heating element 20 to the sectional areas of the lead portions 21 and 22 is predetermined as described above. The heating element can be immediately heated to achieve fast heating and the saturation temperature can be properly controlled, thereby performing the after glow operation for a long period of time. More specifically, the self temperature saturation properties are given such that the sectional area ration $\epsilon(=SH/SL)$ of the sectional areas SH of the heating element 20 to the sectional areas SL of the lead portions 21 and 22 falls within the range which satisfies conditions (e.g., the ceramic heater strength, the starting charcateristics of the engine, and the temperature rise characteristics) required for the heater 11. When the heat capacity of the heating element 20 is decreased, the temperature rise characteristics (FIG. 3(*a*)) can be improved. However, when the heat capacity is excessively small, the combustion chamber of the engine is cooled by fuel or swirl sprayed at the start time, and the temperature is rapidly decreased, thereby degrading the starting characteristics of the engine. This also adversely affects the mechanical strength of the glow plug. When the heat capacity is increased, the temperature increase to 800° C. requires 10 seconds or more, as shown in FIG. 3(*a*), and the temperature rise characteristics are degraded. Furthermore, when the saturation temperature exceeds 1,100° C., as shown in FIG. 3B, the strength of the plug is degraded. In consideration of the above circumstances, the sectional area ration $\epsilon$ must fall within the following range:

$$0.15 \leqq \epsilon(=SH/SL) \leqq 0.6$$

When various conditions are taken into consideration, an ideal ratio within the above range is $\epsilon=0.3$ (indicated by P in FIGS. 3(*a*) and (*b*)).

In the above ceramic heater 11 according to the present invention, the resistor member is integrally made of a resistive ceramic material. As compared with the conventional metal heating resistor, workability, durability, and the like of the ceramic resistor can be improved. In addition, the conductive SiAlON described above has a large positive resistance/temperature coefficient and advantageously provides good self temperature saturation properties.

The diameters of the heating element 20 and lead portions 21 and 22 of the heater 11 can be arbitrarily controlled at the time of molding, and the resistance of the heater 11 can therefore be arbitrarily controlled. For example, assume that the diameter of the heater 11 is 5 mm, that the diameter of the heating element 20 is 3 mm, and that its length is 50 mm (excluding a length of 5 mm of the electrode extraction end 26 or 27). Under these assumptions, the length of the heating element 20 is set to be 10 mm, and the insulating coating layers and 23 and 24 are formed for a length of 20 mm from the position 25 mm from the distal end. The heat capacity of the heating element 20 can be smaller than that of the lead portions 21 and 22. A desired resistance can be set to obtain the required self temperature saturation characteristics. In this case, the sectional area ratio $\epsilon$ is 0.27 and is close to the ideal value of 0.3.

Figure 7:
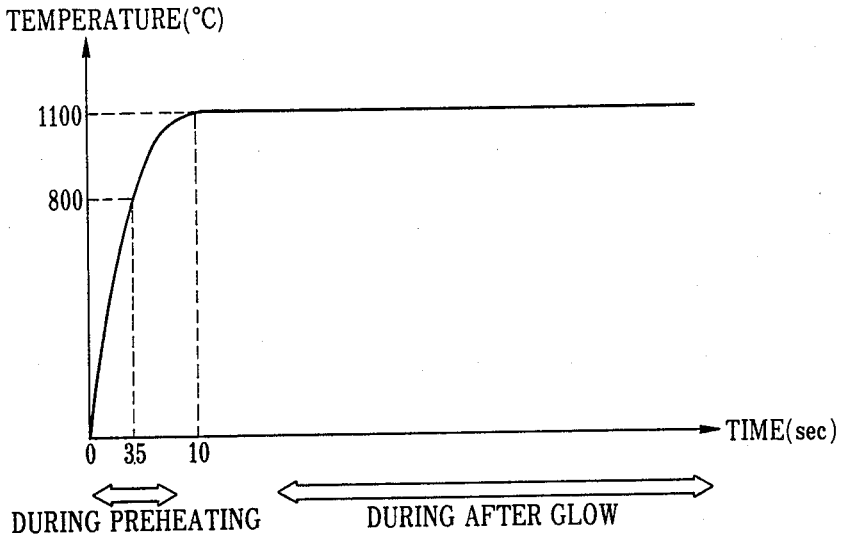
FIG. 7 is a graph showing temperature characteristics of the ceramic heater.

When a substantially U-shaped integral ceramic heater 11 made of the resistive ceramic material is used, good characteristics of the glow plug 10 can be obtained, as shown in FIG. 7. More specifically, according to the glow plug 10 of this embodiment, the plug can be kept at about 1,100° C. when the plug is heated to 800° C. in 3.5 seconds and the allowable range of the saturation temperature is set to be 1,200° C. or less, as indicated by the solid line in FIG. 7.

Figure 8:
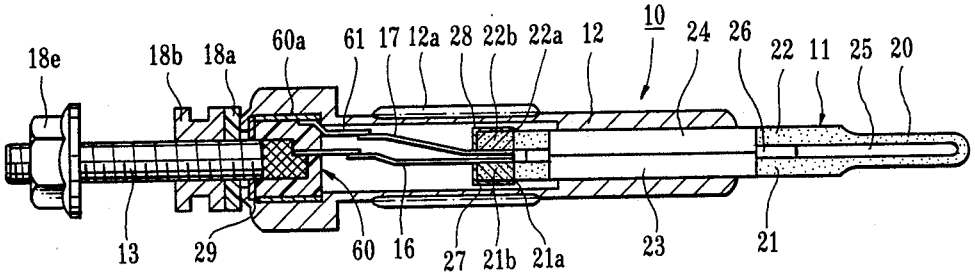
FIG. 8 is a longitudinal sectional view of a glow plug for a diesel engine according to another embodiment of the present invention.

In the above embodiment, the glow plug 10 having the bipolar two-line ceramic heater 11 has the structure in which the first and second external connecting terminals 13 and 14 of the terminal assembly 15 arranged at the rear end portion of the holder 12 are connected to a source of electrical power. However, the present invention is not limited to this structure. A glow plug 10A shown in FIG. 8 can also be proposed. In this plug, only a lead portion 21 is connected to the engine through an external connecting terminal 13 through an insulating bushing 60, and a lead portion 22 is grounded to a holder 12. In the embodiment of FIG. 8, a metal conductor 17 is connected to a terminal piece 61 extending from a metal pipe 60*a* connected to the holder 12 mounted on the outer surface of the insulating bushing 60. However, the structure is not limited to this. Various modifications may be made as a connecting means for the holder 12.

According to the present invention as described above, in the rod-like ceramic heater held at the distal end portion of the holder, the pair of external connecting lead portions extending backward from the both ends of the U-shaped heating element and the resistive ceramic material are integrally formed of the resistive ceramic material. The diameter of the U-shaped heating element is smaller than that of the lead portions such that the ratio $\epsilon(=SH/SL)$ of the sectional areas of the U-shaped heating element to the sectional areas SL of the lead portions falls within the range of $0.15 \leqq \epsilon \leqq 0.6$. As the heating element of a simple, inexpensive heater is exposed, the distal end of the heater can be immediately heated to obtain a fast heating glow plug. The heat capacity of the heating element at the distal end of the resistive ceramic material is reduced to obtain good self temperature saturation properties, thereby properly controlling the saturation temperature. The after glow operation for a long period of time can be achieved to reduce the exhaust gas and noise of the engine. In addition, the voltage can be simply controlled during the after glow operation, and durability of the heating element can be improved.

Figure 9:
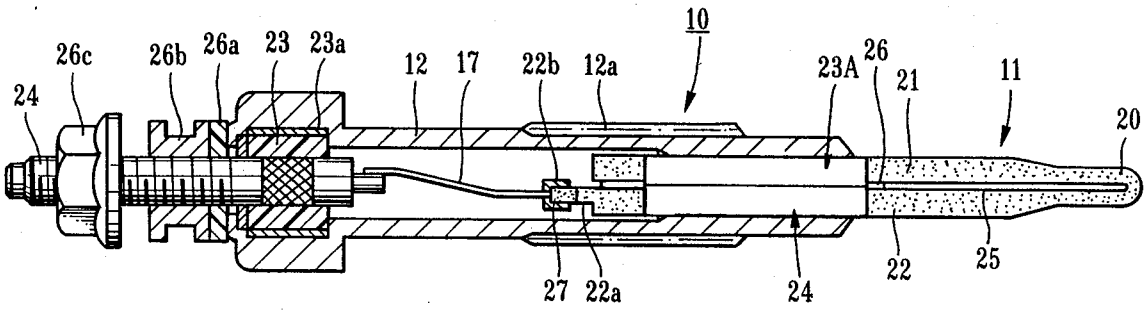
FIG. 9 is a longitudinal sectional view showing a modification of the glow plug of the present invention.

The present invention is not limited to the particular embodiments described above. Various changes and modifications may be made within the spirit and scope of the invention. FIG. 9 shows a modification of the present invention. In this modification, the metal holder 12 is grounded or connected to another electrode. The same reference numerals as in FIG. 1 denote the same parts in FIG. 9.

Referring to FIG. 9, of the external connecting lead portions 21 and 22 constituting a rod-like ceramic heater 11 of glow plug 10B, the lead portion 21 is bonded and held by the metal holder 12 through a conductive coating layer 23(*a*). The lead portion 22 is insulated by an insulating coating layer 23*b*, from the metal holder 12 in the same manner as in the above embodiments. A rear end 22*a* of the lead portion 22 is covered with a conductive coating layer 22*b*. One end of the metal conductor 17 is fixed together with the terminal cap 27 on the conductive coating layer 22*b*. The heating element 20 having small sectional areas and the lead portions 21 and 22 having larger sectional areas than those of the element 20 are provided in the same manner as in the above embodiments.

The external connecting terminal 24*a* is coaxial with the rear end portion of the holder 12 through the insulating bushing 23*b*. The external connecting terminal 24*a*, is connected to resistive ceramic lead portions constituting the ceramic heater 11 through a metal conductor 17 such as a flexible wire. Reference numeral 23*a* denotes a metal pipe mounted on the outer surface of the insulating bushing 23*b*. The metal pipe 23*a* is axially deformed by a high pressure at the rear end portion when the holder 12 is assembled. The insulating bushing 23*b* is fixed to the holder 12 with predetermined mechanical strength so as to limit the influence of temperature. Reference numerals 26*a*, 26*b*, and 26*c* denote an insulating ring, a fixing nut, and an external lead fastening nut, all of which are threadably engaged wtih the threaded portion of the rear end portion of the external connecting terminal 24. The external connecting terminal 24*a* is threaded between the nuts 26*b* and 26*c* and is electrically connected to a battery terminal. A male thread 12*a* is threadably engaged with a female thread formed in the cylinder head of an engine (not shown), so that the holder 12 is electrically grounded. At the same time, the distal end of the holder 12 extends inside a subcombustion or combustion chamber.

Figure 10B:
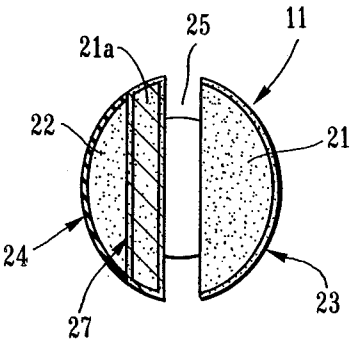
FIGS. 10(*a*) and 10(*b*) are sectional views showing modifications of the present invention.
Figure 10A:
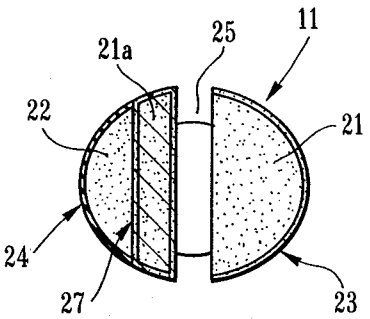

The shape of the ceramic heater 11 is not limited to the rod-like shape, but may have a rectangular or square section. The cross-sectional shape of the ceramic heater 11 may be an elliptical, as shown in Figs. 10(*a*) and 10(*b*) which show two possible elliptical shapes 10A 10B. In the heater 11 having any shape, it is apparent that a small-diameter portion is formed with a size for satisfying the above-described sectional area ratio of the heating element 20 to the lead portions 21 and 22 so as to obtain fast heating and self saturation properties. A slit 25 is formed between the lead portions 21 and 22 and extends from the heating element along the longitudinal direction of the heater 11. An insulating sheet 26 made of an insulating ceramic material is inserted at a portion corresponding to at least the distal end portion of the holder 12. The insulating sheet 26 is integrally bonded to the resistive ceramic lead portions 21 and 22, thereby properly preventing the combustion pressure and heat from leaking or being conducted through the slit. However, this insulating sheet 26 may be omitted in practice.

What is claimed is:

1. A glow plug for a diesel engine, comprising:

a hollow holder; and a heater comprised of SiAlON extending through a distal end portion of said hollow holder and held thereby;

said heater being provided with an exposed U-shaped heating element and a pair of lead portions extending backward from both ends of said U-shaped heating element and parallel to each other, said heating element and said pair of lead portions being integrally made of a resistive ceramic material, one of said lead portions being coupled to one end of an electrically conducting flexible wire, a second end of said wire being coupled to an external connecting terminal extending into the other end of said holder, wherein a ratio (=SH/SL) of cross-sectional areas SH of the leg portions of the U-shaped heating element to cross-sectional areas SL of said lead portions falls with a range of $0.15 \leqq \epsilon \leqq 0.6$.

2. A plug according to claim 1, wherein said holder is electrically conductive and the other of the lead portions is electrically connected to said hollow holder, and said one of said lead portions is electrically insulated from said holder and is engaged with said external connecting terminal and electrically connected therewith by said flexible wire, said terminal being electrically insulated from said holder and said other end portion of said hollow holder has a structure for fixing said external connecting terminal accommodated therein.

3. A plug according to claim 1, wherein said ceramic heater is integrally formed of a SiAlON ceramic material obtained by controlling the mixing ratio of titanium nitrate to a SiAlON containing a $\beta$-phase SiAlON or a mixture of $\alpha$ and $\beta$-phase SiAlON so as to obtain a positive resistance temperature characteristic.

4. A plug according to claim 1, wherein said holder is electrically conductive, an insulating member supporting said external connecting terminal so as to insulate said external connecting terminal from said hollow holder;

said external connecting terminal being electrically connected to said one of said lead portions of said ceramic heater through said flexible wire and said hollow holder being electrically connected to the other one of said lead portions of said ceramic heater.

5. A plug according to claim 1 wherein said hollow holder is electrically conductive and, further comprising:

a second external electrical connection terminal;

an insulating member supporting said pair of external connection terminals such that said pair of external connection terminals are electrically insulated from each other and from said hollow holder;

another electrically insulating member insulating said pair of lead portions of said ceramic heater from said hollow holder; and a second electrically conducting wire connecting the other lead portion to said second external wire.

6. A plug according to claim 1, further including a member of electrical insulating material inserted between said lead portions.

* * * * *

UNITED STATES PATENT AND TRADEMARK OFFICE

CERTIFICATE OF CORRECTION

PATENT NO. : 4,914,274

DATED : 4/3/90

INVENTOR(S) : Hatanaka et al.

It is certified that error in the above-identified patent and that said Letters Patent is hereby corrected as shown below:

| | | |
|---|---|---|
| [57] Abstract, line 12 | delete "ration" | insert --ratio-- |
| col. 07, line 09 | delete "ration" | insert --ratio-- |
| col. 09, line 09 | delete "10A 10B" | |

Signed and Sealed this

Tenth Day of March, 1992

*Attest:*

HARRY F. MANBECK, JR.

*Attesting Officer*

*Commissioner of Patents and Trademarks*